US008826882B2

(12) United States Patent
Tanabe et al.

(10) Patent No.: US 8,826,882 B2
(45) Date of Patent: Sep. 9, 2014

(54) LUBRICATING STRUCTURE OF MULTI-LINK PISTON-CRANK MECHANISM FOR INTERNAL COMBUSTION ENGINE

(71) Applicant: Nissan Motor Co., Ltd., Yokohama (JP)

(72) Inventors: Takashi Tanabe, Machida (JP); Kenshi Ushijima, Kamakura (JP); Makoto Kobayashi, Fujisawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 13/956,766

(22) Filed: Aug. 1, 2013

(65) Prior Publication Data

US 2014/0053797 A1 Feb. 27, 2014

(30) Foreign Application Priority Data

Aug. 24, 2012 (JP) ..... 2012-184697

(51) Int. Cl.

| | |
|---|---|
| ***F01M 1/02*** | (2006.01) |
| ***F01M 1/06*** | (2006.01) |
| *F01M 11/02* | (2006.01) |
| *F02B 75/04* | (2006.01) |
| *F01M 1/08* | (2006.01) |

(52) U.S. Cl.

CPC ..... *F01M 11/02* (2013.01); *F01M 1/06* (2013.01); *F01M 2011/027* (2013.01); *F02B 75/048* (2013.01); *F01M 1/08* (2013.01)

USPC ..... 123/196 R; 123/48 B; 123/78 E

(58) Field of Classification Search

CPC ..... F01M 1/06; F02B 75/32; F02B 75/04; F02B 75/045

USPC ..... 123/196 CP, 196 R, 48 B, 78 E; 184/6.5

See application file for complete search history.

(56) References Cited

U.S. PATENT DOCUMENTS

| | | | | |
|---|---|---|---|---|
| 2002/0043228 | A1* | 4/2002 | Moteki | 123/78 E |
| 2006/0096810 | A1* | 5/2006 | Eto et al. | 184/6.5 |

* cited by examiner

*Primary Examiner* — Hung Q Nguyen
(74) *Attorney, Agent, or Firm* — Young Basile

(57) ABSTRACT

A lubricating mechanism of a multilink, piston-crank mechanism for an internal combustion engine is provided. At a predetermined crank angle at which the crank pin oil passage and the lower link oil passage are communicative, viewed in the direction of the crankshaft, along a straight line connecting the center of rotation of the crank shaft and the end of the lower link oil passage at the side opposed to the pin boss opposing surface, the pin boss portion is disposed as the lubricating object. On the axial side of the pin boss portion, a recess portion is provided.

10 Claims, 7 Drawing Sheets

FIG. 3A
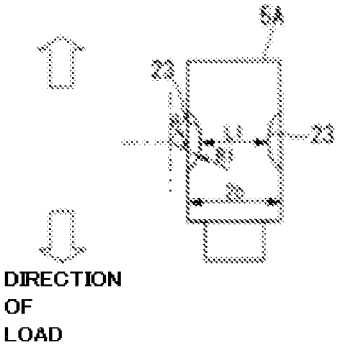
FIG.3B
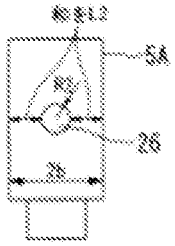
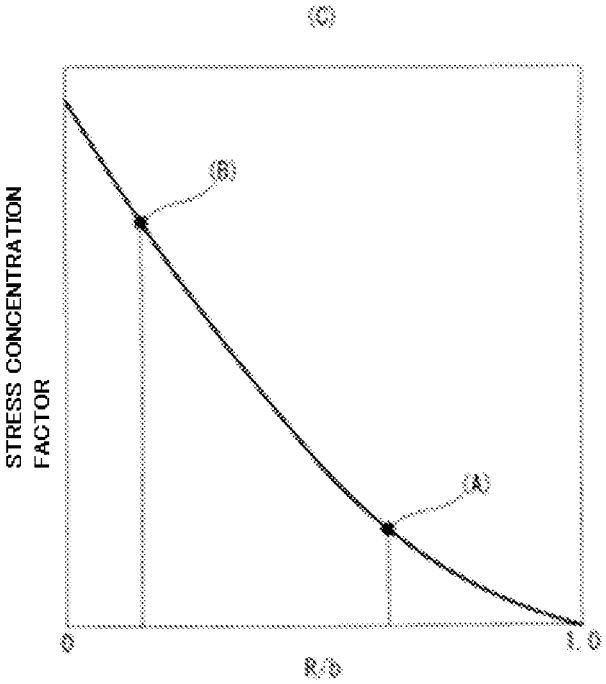
FIG. 3C

FIG. 7A
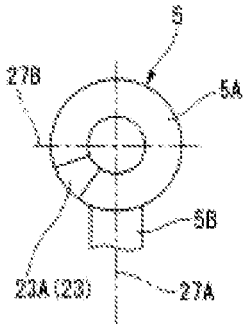
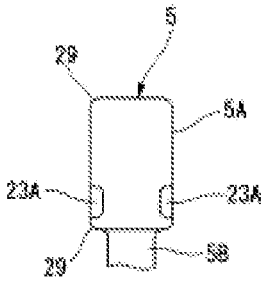
FIG. 7B
FIG. 7C
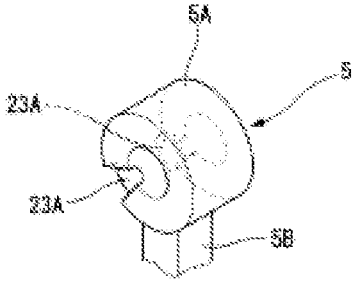
FIG. 8A
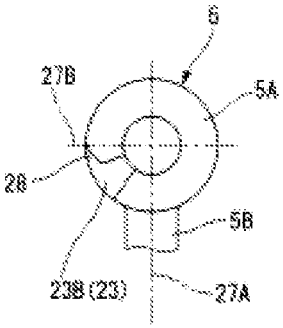
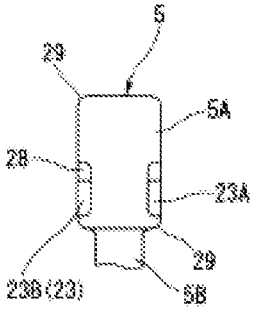
FIG. 8B
FIG. 8C
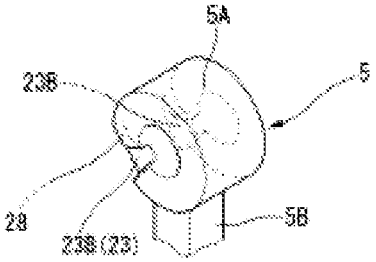

FIG. 9A
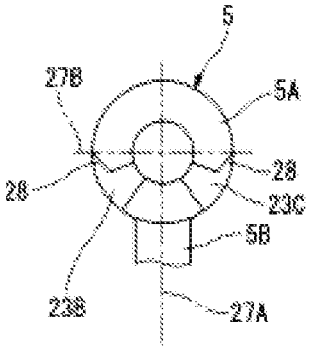
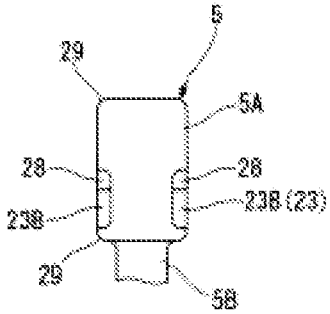
FIG. 9B
FIG. 9C
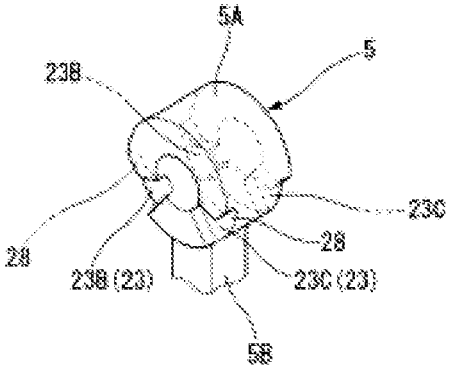

LUBRICATING STRUCTURE OF MULTI-LINK PISTON-CRANK MECHANISM FOR INTERNAL COMBUSTION ENGINE

CROSS-REFERENCE TO RELATED APPLICATIONS

This application claims priority under 35 U.S.C. §119 to Japanese Patent Application No. 2012-184697, filed Aug. 24, 2012, the entire disclosure of which is hereby incorporated herein by reference.

TECHNICAL FIELD

The present invention generally relates to a multi-link, piston-crank mechanism for an internal combustion engine, and relates in particular to a lubricating structure of a pin axis or shaft bearing portion.

BACKGROUND

Conventionally, a technology in which a multi-link, piston-crank mechanism is used for connecting a piston pin and a crank pin of an internal combustion engine is known such as in Japanese Patent Application Publication No. 2010-185329. This is provided with an upper link connected to a piston pin of a piston, a lower link connecting this upper link and a crank pin of a crankshaft, and a control link with its one end supported pivotally on the side of an engine body and with the other end connected to the lower link. The upper link and the lower link are connected via an upper pin rotatably relative to each other while the control link and the lower link are connected via a control pin for being rotatable relative to each other.

The lower link in the piston-crank mechanism of the multi-link type is subjected to receive a combustion pressure (cylinder pressure) through the upper link, and the force is transferred to the crank pin by way of a sort of "lever" with fulcrum positioned on the control pin. Accordingly, the lower link is exposed to a high combustion pressure or inertial load received by a piston from a bearing portion of the upper pin through the piston pin, the upper link and the upper pin. At the same time, so as to balance with the load, the load is also generated in the control pin bearing portion and the crank pin bearing portion. Therefore, the surface pressure of each bearing portion will be severe as compared to a conventional reciprocating engine of the single-link in order to prevent seizing and wear and to maintain sufficient lubrication state.

In particular, with respect to the lubrication of the bearing portion of the upper pin connecting the lower link and the upper link, while the lower link revolves around the crankshaft with the crank pin in response to rotation of the crankshaft during engine operation, it also displaces in the rotational direction with respect to this crank pin. Therefore, it is difficult to supply lubricating oil forcibly by using the hydraulic pressure.

Thus, in the technique described above, an oil passage is formed in each of the crank pin, the lower link, and the upper pin in their pin boss portions, respectively so as to establish communication of the oil between the oil passage of the crank pin and that of the lower link. Thus lubricating oil will be injected from the oil passage in the lower link toward the oil passage of the pin boss portion so as to provide lubricating oil to the bearing portion of the pin boss portion of the upper link via this oil passage of the lower link.

BRIEF SUMMARY

However, in the technique described above, no consideration is given to the influence of inertia due to rotation of the crankshaft when injecting the lubricating oil from the lower link. Therefore, there is a possibility that the lubricating oil injected from the oil passage of the lower link at high rotation speed will be spirit at location shifting from the position of the oil passage formed in the pin boss portion to be supplied with subsequent decrease in oil supply quantity.

Also, when the oil passage is formed through the pin boss portion of the upper link as shown in the technique described above, a stress concentration tends to occur easily around the oil passage to lower the strength so that ensuring durability and reliability will be difficult.

The present invention has been made in view of these situations, and in a structure in which lubricating oil is supplied by injection to the pin boss portions of the upper link and the control link from the oil passage of the lower link, much of the lubricating oil injected from the lower link will be suitably guided to the pin axis or shaft bearing portion of the pin boss portion. Therefore, the present invention aims to provide a new lubricating structure of the multi-link, piston-crank mechanism for an internal combustion engine which may both ensure a lubricating oil quantity thereby improving the lubrication performance and secure a strength of the pin boss portion.

The present invention relates to a lubricating structure of a multi-link, piston-crank mechanism for an internal combustion engine. The multi-link, piston-crank mechanism is provided with an upper link with its one end connected to a piston via a piston pin, a lower link connected via an upper pin to the other end of the upper link while being attached to a crank pin of the crankshaft rotatably, and a control link with its one end connected pivotally to an engine body while being connected with the other end to the lower link via a control pin.

The crank pin is formed with a crank pin oil passage that extends radially within the crank pin and opens with one end to the outer periphery of the crank pin for supplying lubricating oil at a predetermined pressure. A lower link oil passage formed in the lower link passes through between an pin boss opposing surface which is opposed to either the pin boss portion of the upper link to which the upper pin is fitted rotatably or the pin boss portion of the control link to which the control pin is fitted rotatably and the bearing shaft surface of the crank pin.

At a predetermined crank angle at which the crank pin oil passage and the lower link oil passage are communicated to each other, viewed in the direction of the crankshaft, along a straight line connecting the rotation center of the crank shaft and the end of the lower link oil passage at the side of the pin boss opposing surface, the pin boss portion is disposed as the object to which lubricating oil is to be supplied. On the axial side of the pin boss portion to which the lubricating oil is to be supplied, a recess portion which is axially recessed is provided.

Thus, at the predetermined crank angle at which the crank pin oil passage and the lower link oil passage are communicated, the lubricant supplied to the crank pin oil passage at a predetermined pressure is injected out from the end of the lower link oil passage on the pin boss opposing surface side, and a part of that will be supplied to the bearing portions of the upper pin or control pin through the recess portion recessed in the pin boss portion on the axial side surface.

Note that, since the pin boss portion as lubricating oil supply object is disposed in the straight line connecting the rotation center of the crankshaft and the end of the lower link oil passage on the pin boss opposing surface side from which lubricant is injected, due to inertial force in response to crankshaft rotation, much of the lubricant injected from the end of the lower link oil passage on the side of the pin boss opposing surface will be directed to the pin boss portion representing the lubricant supply target so that the lubricant quantity to be supplied to the pin boss portion may be secured sufficiently.

Further, as a structure for guiding a lubricating oil which is supplied by injection to the pin boss portions to the pin bearing portion, a recess is formed in the axial side surface of the pin boss portion. Thus, as compared to the oil passage being formed through, the stress concentration may be alleviated to suppress reduction in strength in the pin boss portion.

According to the present invention, by supplying lubricating oil to the pin bearing portions of the upper link or the control link through the crank pin oil passage, lower link oil passage, and the recess portion formed on the axial side surface of the pin boss portion, the lubricant quantity to the pin bearing portion may be secured and the lubricating performance may be improved. In addition, because of the recess portion formed on the axial side surface of the pin boss portion being formed, as compared to the case in which an oil passage is formed through the pin boss portion, the stress concentration may be alleviated and the strength reduction of the pin boss portion may be prevented from its strength reduction.

BRIEF DESCRIPTION OF THE DRAWINGS

Referring now to the attached drawings which form a part of this original disclosure:

FIGS. 3A-3C are explanatory diagrams respectively showing the embodiment FIG. 3A in which a recess portion is provided on the pin boss portion, Comparative Example shown in FIG. 3B with a through hole, and FIG. 3C being a graph to illustrate stress concentration factor (C) FIG. 3C comparing the stress concentration C for FIGS. 3A and 3B;

FIG. 4A is a load diagram illustrating the maximum torque or maximum output exerted on the lower link while

FIG. 5A is a load diagram showing a combustion load applied or exerted on the crank pin while

FIG. 7A is a front view, FIG. 7B is a side view and FIG. 7C is a perspective view of an example of the recess portion;

FIG. 8A is a front view, FIG. 8B is a side view and FIG. 8C is a perspective view of another example of the recess portion; and FIG. 9A is a front view, FIG. 9B is a side view and FIG. 9C is a perspective view of still another example of the recess portion.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
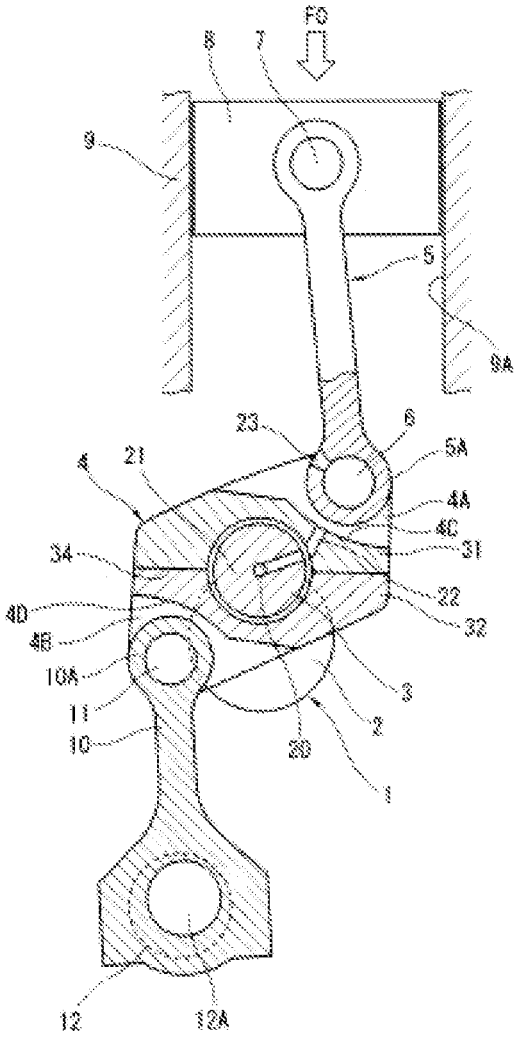
FIG. 1 is sectional view showing an embodiment of the multilink type, crank-piston internal combustion engine according the present invention.

FIG. 1 is a configuration example in which the multi-link type, piston-crank mechanism is configured as a variable compression ratio mechanism. This mechanism is provided as main components with a multi-link, piston-crank mechanism mainly composed of lower link 4, upper link 5, and control link 10. Crankshaft 1 is provided with a plurality of journal portions 2 and crank pin 3, and the journal portions 2 are supported rotatably on a main bearing of cylinder block 9. The crank pin 3 is disposed and eccentric by a predetermined amount from the journal portion 2, to which lower link 4 is attached rotatably.

For possible assembly at a later stage, the lower link is composed of a pair of divided lower link members 31, 32 to be fastened by bolts (not shown). The upper link 5 is connected with the upper side pin boss portion 5A on the lower end thereof to a first lower side pin boss portion 4A of lower link 4 via upper pin 6 for relatively rotatably while with the upper end to piston 8 via piston pin 7 for relatively rotatably. The piston 8 reciprocates within cylinder 9A of cylinder block 9 in response to receipt of combustion pressure.

The control link 10 that restrains the movement of lower link 4 is connected with the control side pin boss portion 10A on the upper end to a second lower side pin boss portion 4B of lower link 4 via control pin 11 relatively rotatably while the lower end is supported on the lower part of the cylinder block 9 forming a part of the engine body via a control shaft 12. More specifically, control shaft 12 is supported on engine body relatively rotatably and has an eccentric cam portion 12A eccentric from the center of rotation so that the lower end of the control link 10 is fitted rotatably on this eccentric cam portion 12A. The control shaft 12 is controlled in its rotational position by a compression ratio control actuator based on a control signal from an engine control unit not shown.

In the variable compression ratio mechanism using a multi-link type, piston-crank mechanism, when the control shaft 12 is rotated by the compression ratio control actuator, the center position of the eccentric cam portion 12A, in particular, a relative position with respect to the engine body changes. Thus, a pivot support position of the lower end of the control link 10 is changed. Then, with the pivot support position of the control link 10 being changed, the stroke of the piston 8 is changed, the position in piston at the piston being at piston dead center (TDC) may be set higher or lower. Thus, it is possible to change the engine compression ratio. That is, control shaft 12 having an eccentric cam portion 12A, the compression ratio control actuator, and the engine control unit or the like constitutes a variable compression ratio means for varying the engine compression ratio.

The first lower side pin boss portion 4A of the lower link 4 is formed in such bifurcated so as to sandwich the upper-side pin boss portion 5A. The hollow-shaped upper pin 6 is fitted through and engaged with upper side pin boss portion 5A. The upper pin 6 is fixed by press-fitting to the first lower side pin boss portion 4A bifurcated at both ends. Therefore, the pin boss opposing surface 4C formed between a bifurcated, first lower-side pin boss 4A is configured to oppose the outer periphery of upper-side pin boss portion 5A.

Similarly, the second lower side pin boss portion 4B of the lower link 4 is formed in such bifurcated so as to sandwich the control-side pin boss portion 5A. The control pin 11 is fitted into and engaged with the control-side pin boss portion 10A and is fixed by press-fitting to the second lower side pin boss portion 4B bifurcated at both ends. Therefore, the pin boss opposing surface 4D formed between the bifurcations of second lower-side pin bosses 4B is configured to oppose the outer periphery of control-side pin boss portion 10A.

The crank pin 3 is formed with oil passage 21. The crank pin oil passage 21 extends linearly in the radial direction, and one end thereof is open to the outer peripheral surface of the crank pin 3. The crank pin oil passage 21 is supplied with lubricating oil under a predetermined pressure pressurized by an oil pump not shown through an axial oil passage 20 extending in an axial direction of crankshaft 1. Lower link 4 is provided with a lower link oil passage 22. This lower link oil passage 22 penetrates the pin boss opposing surface 4C opposing the outer periphery of upper-side pin boss portion 5A and the crank pin bearing surface, i.e. inner periphery of the bearing metal, including a bearing metal (not shown) fitted in a bearing portion of crank pin 3.

Now, the configuration and operational effect of the characteristics of the illustrated embodiment are described below. In the following description, although description is made of the lubricating mechanism of the upper-side pin boss portion 5A of the upper link 5, similar lubricating mechanism may be applied to the control-side pin boss portion 10A of control link 10.

Figure 2:
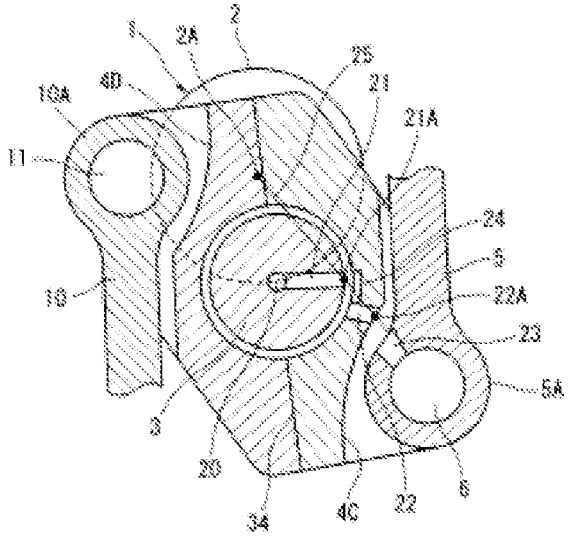
FIG. 2 is a sectional view showing a vicinity of the lower link.

[1] As shown in FIG. 2, on each side of the pin boss portion 5A of upper link 5 in the axial direction, a recess 23 recessed in the axial direction is provided. This recess 23 extends radially from the outer periphery of pin boss portion 5A to the inner periphery serving as a bearing surface of upper pin 6. Further, at a predetermined crank angle, for example at the crank angle near the bottom dead center where the inertia force increases, crank pin oil passage 21 and lower link oil passage 22 are brought into communication via a circumferential oil passage 24 described below, and lubricant will be supplied by injection from the end 22A on the pin boss opposing surface side of lower link oil passage 33 toward pin boss portion 5A. At this crank angle such as this at which lubricant will be supplied by injection, in a direction viewed from crankshaft axial direction, in a straight line formed by connecting the rotation center 2A of journal portion 2 of crankshaft 1 and the end 22A of the lower link oil passage 22 on the pin boss opposing side, pin boss portion 5A is configured to be disposed, and more specifically, a recess 23 is disposed, which is recessed on the side surfaces of this pin boss portion 5A.

Thus, in the link disposition at a predetermined crank angle where the crank pin oil passage 21 communicates with the lower link oil passage 22, the lubricant oil at predetermined pressure supplied to crank pin oil passage 21 will be injected from the end 22A of lower link oil passage 22 at its pin boss opposing surface side, and supplied to bearing portions of upper pin 6 via the recess 23 of pin boss portion 5A.

Note that, since along the straight line 25 connecting the rotation center 2A of the crankshaft 1 and the end 22A of lower link oil passage 22 at the pin boss opposing surface side, from which the lubricating oil is injected, i.e., along the direction (25) in is applied in response to rotation of crankshaft 1 the recess 23 of pin boss portion 5A is configured to be disposed as the lubricant supply target, by using the inertia force in response to rotation of crankshaft 1, much of the lubricating oil injected from the end 22A of the lower link oil passage 22 at the pin boss opposing surface side may be guided to recess 23 of pin boss portion 5A as the lubricant supply target. Thus, a sufficient quantity of lubricating oil may be secured to improve the lubricating performance of the pin bearing portions.

Further, in order to obtain a structure for guiding into the recess 23 a lot of lubricating oil injected from the lower link oil passage 22, it is sufficient to arrange end 22A of lower link oil passage at the pin boss opposing side in a straight line 25 along the direction of inertia force so that the passage shape, direction and the like of lower link passage 22 may be appropriately set considering the strength and the like of lower link 4 into account, so that the degree of freedom of layout is high. Therefore, it is easily feasible to balance and securing of the lubricating oil amount and ensuring the strength.

With reference to FIGS. 3A-3C, FIG. 3A schematically shows the structure of the embodiment described above in which a recess 23 is formed on both side surfaces of the pin boss portion 5A in the axial direction, while FIG. 3B schematically shows a structure in Comparative Example where a through hole 26 is formed as an oil passage communicating the outer periphery of pin boss portion 5A and the inner periphery thereof. The link width 2*b* is the same for both Embodiment (A) and Comparative Example B.

Further, the flow passage cross-sectional area of recess 23 and that of through hole 26 are equivalent and the flow rate is substantially the same. In this case, the link minimum width L1 in the Embodiment (A) is larger than link minimum width L2 in Comparative Example (B), and the radius of curvature R1 of the recess 23 is larger than the curvature radius of the through hole 26. Therefore, as shown in FIG. 3C, in the structure of the Embodiment, of (A), as compared with the structure of Comparative Example (B), the stress concentration is reduced with the stress concentration factor with respect to the input load of the same being smaller. Thus, it is possible, in combination with the increase in link width (L1>L2), that the strength of the pin boss portion 5A may be greatly increased.

[2] As shown in FIG. 2, at the predetermined crank angle at which the crank pin oil passage 21 and the lower link oil passage 22 are communicated, viewed from the crankshaft direction, in the straight line 25 connecting the rotation center 2A of crankshaft 1, end 21A of crank pin oil passage 21 at the outer periphery side, and the end 22A of the lower link oil passage 22, recess 23 of pin boss portion 5A as the lubricant supply target part is disposed. Stated another way, along the direction of inertia force (straight line 25) of crankshaft 1 directing the recess 23 of pin boss portion 5A as the lubricant supply target part and end 21A of crank pin oil passage 21 on the outer periphery side are arranged. Therefore, by using inertia force in response to rotation of crank shaft 1, a flow of lubricant that is injected from crank pin oil passage 21 via lower link oil passage 22 to recess 23 of pin boss portion 5A will be facilitated so that the lubricant oil quantity sufficient for pin bearing portion of pin boss portion 5A may be furnished reliably.

[3] As shown in FIG. 2, in the bearing portion of the crank pin 3, the circumferential oil passage 24 extending in the circumferential direction is formed. In the range of a predetermined crank angle, the crank pin oil passage 21 and lower link oil passage 22 are communicative through the circumferential oil passage 24. The circumferential oil passage 24 in the present embodiment is formed and recessed in the inner circumferential surface of the lower link 4 which constitutes a bearing surface of the crank pin 3, the circumferential oil passage 24 may be recessed on the outer peripheral surface of the crank pin 3 or may be provided as a circumferential oil passage 24 of the bearing metal of (semi-) cylindrical shape interposed between crank pin 3 and lower link 4. Thus, by providing the circumferential oil passage 24 to the bearing portion of the crank pin 3, it is possible to expand the range of the crank angle in which the lower link oil passage 22 and the crank pin oil passage 21 are communicated to prolong an injection period of the lubricating oil to thereby injection period longer and to further improve the lubrication performance by increasing the supply amount of the lubricating oil.

Figure 4A:
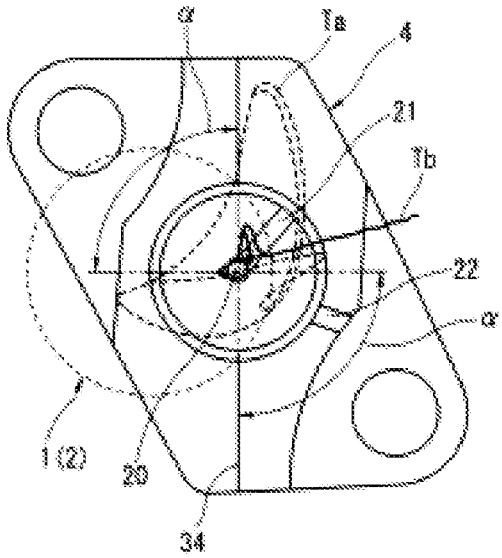
Figure 4B:
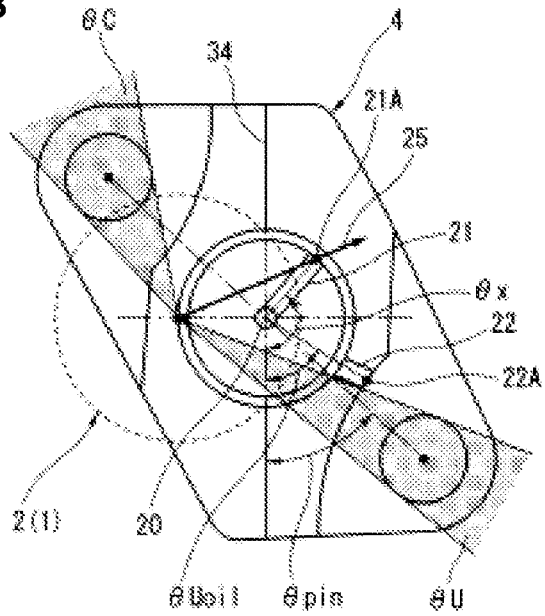
FIG. 4B is an explanatory diagram showing the formation position of the lower link oil passage.

[4] With reference to FIGS. 4A and 4B, lower link passage 22 is disposed at a position of the low load input. That is, as shown in FIG. 4A, lower link 22 is arranged in a range of a predetermined angle c about the center of crank pin bearing surface so that the region of application of maximum torque Ta or maximum power Tb is avoided. More specifically, lower link oil passage 22 is set in the range a within a predetermined angle (about 90 degrees) centering on the line connecting the center of the crank pin bearing surface and the centers of pin (6,11). To be even more specific, the lower link oil passage 22 is set within a range c of a predetermined angle (about 90 degrees) to the sides of pin (6, 11). Thus, by arranging or positioning the lower link passage 22 at a position of low load input, despite the structure with lower link oil passage being formed, it is possible to secure the strength of lower link 4 against the load input with ease so that both improvement in lubrication performance and securing strength of lower link 4 are achieved.

Figure 5A:
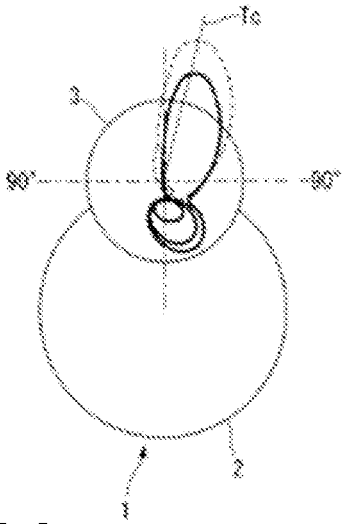
Figure 5B:
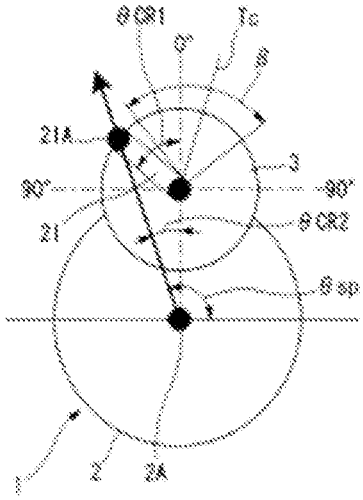
FIG. 5B is an explanatory diagram showing the formation position of the crank pin oil passage.

[5] With reference to FIGS. 5A and 5B, the crank pin oil passage 21 is disposed to avoid the input position of the combustion load. Specifically, in a coordinate system in which the counterclockwise direction relative to the reference (0°) of the direction toward the crank pin center from the rotation center 2A of the crankshaft 1 is defined as a positive rotation direction, the peak Tc of the combustion load is applied at about −25°. Therefore, a predetermined angle range β (about 90 degrees) centering on this peak Tc of the combustion load application, i.e. the range β between about minus 70 degrees and about plus 20 degrees is avoided for the location of the end 21A of crank pin oil passage 21 on the outer periphery side. Thus, by arranging or positioning the crank pin passage 21 so as to avoid the position of combustion load input, despite the structure with crank pin oil passage 21 being formed, it is possible to secure the strength of crank pin 3 against the combustion load input with ease so that both improvement in lubrication performance and securing strength of crank pin 3 are achieved.

Figure 6:
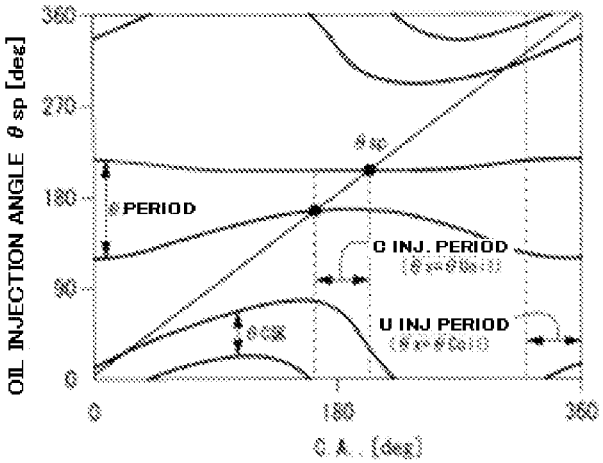
FIG. 6 is an explanatory diagram showing an example of a U injection period to the upper side pin boss portion while a C injection period to control link side pin boss portion.

With reference to FIG. 4B and FIG. 6, θx indicates the direction of the splash injected from the crank pin oil passage 21 and corresponds to the angular position of the outer end portion 21A of the crankpin oil passage 21 from the center of the crank pin 3 measured with respect to the mating surfaces 34. θU is the angular range of the injection direction of the lubricating oil when directed to the upper side pin boss section 5A. θC indicates the angular range of the injection direction of the lubricating oil when directed to the control-side pin boss section 5A. θU oil is the angular position of the end 22A of the lower link oil passage 22 at the side of the pin boss opposing or facing surface 34 with respect to the mating surface 34. θpin is an angular position of the center of pin hole with respect to the mating surface 34 and assumes a fixed value that is set in advance. In addition, with reference to FIG. 5 and FIG. 6, θCR1 is the angular position of the outer end portion 21A of the crankpin oil passage 21 extending of the center of the crank pin 3, θCR2 is the angular position of the outer end portion 21A of crankpin oil passage 21 from the crank center 2A on the side of outer periphery. θsp is an oil injection angle (θCR2 +90°). As shown in FIG. 6, injection period to the upper-side pin boss portion 5A (U injection period) is set in the period in which oil injection angle θsp is present within the θU interval or period. Similarly, injection period to the control-side pin boss section 10A (C injection period) is set in the period in which θsp is present within the θC interval or period.

[6] FIGS. 7A-7C, 8A-8C and 9A-9C respectively show examples of the recess provided in the axial direction on the sides of upper link 5 (or control link 10). The upper link 5 (or control link 10) has a structure in which pin boss portion 5A at each end is integrally connected to a rod. Thus, when a line that passes through the pin boss portions 5A at both ends of upper link 5 is defined as a link centerline 27A while a line that passes through the center of pin boss portion 5A and extends orthogonal to the link centerline 27A as a pin boss orthogonal line 27B, respectively, in the vicinity of the pin boss orthogonal lines 27B, tensile stress is maximized. Thus, in the examples shown in FIGS. 7A-7C, 8A-8C and 9A-9C, in order to ensure the strength of the pin boss portion 5A, recess 23 is formed so as to avoid the pin bosses orthogonal line 27B around which the tensile stress is maximized.

[7] The recess 23 is formed to expand at the outer peripheral surface of the pin boss portion 5A than the inner peripheral surface. Specifically, recess 23A shown in FIG. 7A is formed in a fan shape to increase gradually toward the outer peripheral side from the inner peripheral side. Recesses 23B and 23C shown in FIGS. 8A and 9A, respectively, have an extension portion 28 extending circumferentially on the outer circumferential side portion. Thus, by enlarging the outer circumferential side of the recess 23, the lubricating oil is supplied by injection so as to ensure the inflow of the lubricating oil, thereby improving the lubrication performance. Further, by reducing the inner peripheral side of the recess 23 relatively, it is possible to suppress the decrease in strength of the pin boss portion 5A associated with provision of the recess 23.

Out of the pin boss portions 5A, the portion closer to the rod portion 5B, as compared to the portion farther from the rod portion 5B, the strength is higher due to rod portion 5B. Thus, out of the pin boss portions 5A, recess 23 is disposed at the position of the rod portion 5B with respect to the pin boss orthogonal line 27B above, i.e. on the side close to the rod portion having a high strength. More specifically, the recess 23 provided in the vicinity of the base portion at which rod portion 5B is connected to the pin boss section 5A.

[9] The corner portion of the outer peripheral side of the pin boss portion 5A is provided with a curved portion 29 that curves in a predetermined curvature. Thus, by providing the curved portion 29, part of the lubricating oil may flow into the recess 23 along the curved portion 29 to facilitate the flow of lubricating oil into the recess 23, thereby improving the lubrication performance.

[10] In the embodiment shown in FIGS. 9A-9C, on each axial side surface of the pin boss portion 5A, a plurality of recesses 23A and 23B are provided. In this example, the two recesses 23B, 23C are disposed symmetrically with respect to the link center line 27A. As described above, the one recess 23B is disposed at a position where the lubricating oil is supplied by injection from the lower link 4 and functions as a supply oil passage for supplying lubricating oil to the pin bearing portion. The other recess 23C functions as a discharge oil passage for discharging the lubricating oil supplied to the pin bearing portion. Thus, separately from the recess 23B for the oil supply, by providing the recess 23C for the oil discharge, it is possible to facilitate the supply and discharge of lubricating oil to the pin bearing portion and increase the flow rate of the lubricating oil to the pin bearing portion to thereby further improve the lubricating performance.

Although, two recesses are formed on each axial side surface of pin boss portion 5A in the embodiment shown in FIGS. 9A-9C, three or more of the recesses may be formed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A lubricating structure of a multi-link, piston-crank mechanism for an internal combustion engine provided with an upper link with one end connected to a piston via a piston pin, a lower link connected via an upper pin to another end of the upper link while being rotatably attached to a crank pin of a crankshaft, and a control link with one end connected pivotally to an engine body while being connected with another end to the lower link via a control pin, comprising:

a crank pin oil passage extending radially in the crank pin and opening with one end at an outer periphery of the crank pin for supplying a lubricating oil at a predetermined pressure; and a lower link oil passage formed in the lower link and passing through between an opposing surface opposed to either a pin boss portion of the upper link to which the upper pin is rotatably fitted or the pin boss portion of the control link to which the control pin is rotatably fitted, and a bearing shaft surface of the crank pin, wherein, at a predetermined crank angle at which the crank pin oil passage and the lower link oil passage are communicative when viewed in a direction of the crankshaft along a straight line connecting a rotation center of the crank shaft and the end of the lower link oil passage at a side of the opposing surface of the pin boss, the pin boss portion is disposed for lubrication, and wherein a recess is formed in an axial side surface which is recessed in an axial direction.

2. The lubricating structure of a multi-link, piston-crank mechanism for an internal combustion engine as claimed in claim 1, further comprising:

a lubricant oil supply target part disposed at the predetermined crank angle.

3. The lubricating structure of a multi-link, piston-crank mechanism for an internal combustion engine as claimed in claim 1 further comprising:

a circumferential oil passage extending circumferentially in the bearing portion of the crank pin formed so that the crank pin oil passage and the lower link oil passage are configured to be communicative.

4. The lubricating structure of a multi-link, piston-crank mechanism for an internal combustion engine as claimed in claim 1, wherein the lower link oil passage is disposed at a position of a low load input.

5. The lubricating structure of a multi-link, piston-crank mechanism for an internal combustion engine as claimed in claim 1, wherein the crank pin oil passage is configured to avoid a position of a combustion load input.

6. The lubricating structure of a multi-link, piston-crank mechanism for an internal combustion engine as claimed in claim 1, wherein the recess is configured to avoid a pin boss orthogonal line that passes through a center of the pin boss portion and extends orthogonal to a link centerline.

7. The lubricating structure of a multi-link, piston-crank mechanism for an internal combustion engine as claimed in claim 1, wherein the recess is configured to expand on the outer periphery side of the pin boss portion compared to an inner periphery side.

8. The lubricating structure of a multi-link, piston-crank mechanism for an internal combustion engine as claimed in claim 1, wherein the recess is disposed closer to a rod portion connecting the pin boss portions at both ends of either the upper link or the control link.

9. The lubricating structure of a multi-link, piston-crank mechanism for an internal combustion engine as claimed in claim 1, further comprising:

a curved portion at a corner on the outer periphery of the pin boss portion.

10. The lubricating structure of a multi-link, piston-crank mechanism for an internal combustion engine as claimed in claim 1, further comprising:

a plurality of recesses provided on each axial side surface of the pin boss portion.

* * * * *